United States Patent [19]

Mason et al.

[11] Patent Number: 4,741,694

[45] Date of Patent: May 3, 1988

[54] METHOD FOR CALCINING CARBONACEOUS MATERIALS

[75] Inventors: Donald R. Mason, Baton Rouge, La.; Robert L. Chambers, League City, Tex.

[73] Assignees: Reynolds Metals Co., Richmond, Va.; Union Carbide Corporation, Danbury, Conn.

[21] Appl. No.: 717,595

[22] Filed: Mar. 29, 1985

Related U.S. Application Data

[63] Continuation of Ser. No. 581,246, Feb. 17, 1984, abandoned.

[51] Int. Cl.[4] ..... F27B 15/00

[52] U.S. Cl. ..... 432/14; 432/111; 432/105; 432/117

[58] Field of Search ..... 110/229, 230; 432/105, 432/111, 117, 19, 14; 206/216

[56] References Cited

U.S. PATENT DOCUMENTS

| | | | |
|---|---|---|---|
| 2,187,922 | 1/1940 | West et al. | 432/111 |
| 2,555,289 | 5/1951 | Nagel | 432/111 |
| 2,813,822 | 11/1957 | Collier | 432/117 |
| 3,185,464 | 5/1965 | Meyer et al. | 432/105 |
| 3,404,199 | 10/1968 | Hoffmann | 432/111 |
| 3,441,634 | 4/1969 | Iken et al. | 432/111 |
| 3,488,700 | 1/1970 | Iken e al. | 432/111 |
| 3,888,621 | 6/1975 | Williams | 432/19 |
| 4,345,896 | 8/1982 | Abernathy, Jr. et al. | 432/117 |
| 4,354,829 | 10/1982 | Estes | 432/117 |

*Primary Examiner*—Henry G. Yuen
*Attorney, Agent, or Firm*—Alan T. McDonald

[57] ABSTRACT

A method for calcining carbonaceous materials in a rotary kiln is disclosed. An oxygen injection lance provides oxygen through the wall of a firing hood and into the carbonaceous bed, which is at an elevated temperature. The oxygen burns a portion of the carbonaceous material, providing the necessary heat for calcining the remainder of the carbonaceous materials in the kiln.

4 Claims, 1 Drawing Sheet

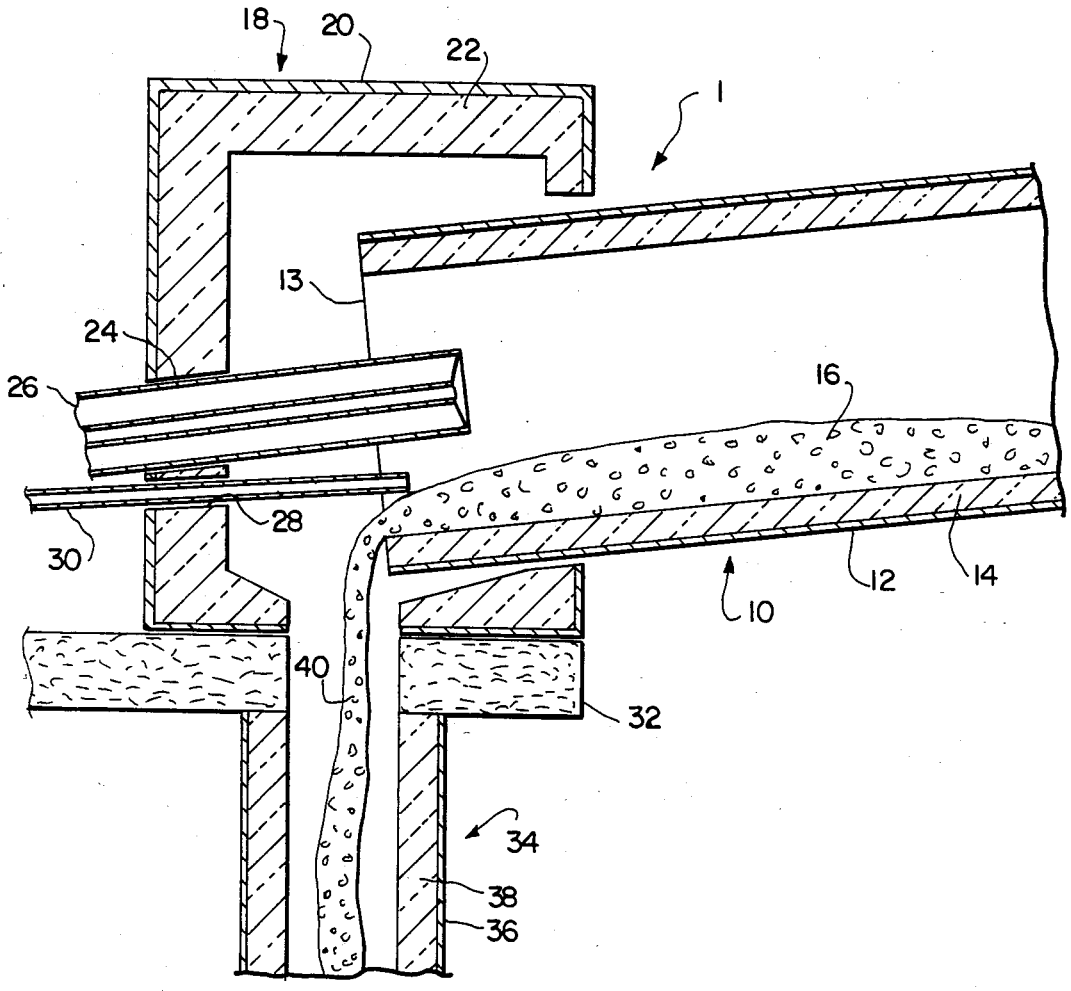
18
20
22
1
13
24
26
16
28
30
12
14
10
40
32
34
38
36

METHOD FOR CALCINING CARBONACEOUS MATERIALS

This application is a continuation of application Ser. No. 581,246 filed Feb. 17, 1984, now abandoned.

BACKGROUND OF THE INVENTION

The present invention relates to improved combustion processes and more particularly to an improved method for calcining carbonaceous material such as petroleum coke.

Carbonaceous materials, such as "green" petroleum coke, are typically calcined in a rotary kiln by introducing these materials into the upper end of a slightly inclined kiln and heating the interior thereof to a temperature of approximately 2200°–2600° F. One technique for heating such a kiln is to fire an end burner disposed in a firing hood at the product outlet end or lower end of the kiln and directing a flame longitudinally through the kiln in the direction generally opposed to that of the product being calcined and along the axis of the kiln. This application of heat is effective to evolve or drive off volatile materials from the green carbonaceous material thereby increasing the density of such materials being calcined. As these gases are evolved from the green carbonaceous material, the heat within the kiln is effective to cause a combustion of such volatile gases which in turn releases heat to the kiln interior and enables the firing rate of the end burner to be reduced below a relatively high firing rate. Frequently, combustion of volatiles in the kiln will supply a majority of the heat required to calcine a green carbonaceous material, such as petroleum coke. Typically, during calcination, at least 99.5% of the volatiles of a green carbonaceous material are evolved therefrom and are combusted, as virtually complete volatilization is required in order to produce a calcined product of suitable quality. With regard to petroleum coke, calcination will typically be effective to increase the density thereof from approximately 1.6 to about 2.6 g/cm$^3$. This enables the resulting petroleum coke to be utilized for several purposes, including use as a fuel.

The burners employed must burn fuels, such as natural gas or fuel oil. Costs of these fuels have increased substantially, thus increasing the cost of the calcining operation.

Several proposed methods for reducing the amount of fuel required to operate a calcining kiln have been proposed. Thus, U.S. Pat. Nos. 2,813,822 and 3,888,621 control airflow within the kiln to improve combustion of the volatile gases. In U.S. Pat. No. 4,354,829, oxygen is introduced to the kiln-mounted blowers of U.S. Pat. No. 2,813,822, in an attempt to further improve the combustion process.

While the known processes have reduced fuel usage, there remains a need for even greater reductions in fuel consumption. It is thus a primary objective of the present invention to substantially reduce combustion fuel usage for the life of a kiln and to eliminate combustion fuel usage during normal operations of the kiln.

It is also a primary objection of the present invention to replace the relatively expensive combustion fuel with relatively inexpensive oxygen during normal operations of the kiln.

It is another primary objective of the present invention to employ a portion of the carbonaceous material being calcined as the fuel for the kiln.

It is yet another objective of the present invention to maintain or improve total material recovery by substantially reducing total gas flows in the kiln.

SUMMARY OF THE INVENTION

By means of the present invention, these desired objectives are obtained.

The method of the present invention comprises injecting gaseous oxygen into the rotary kiln at the lower end of the kiln and into the bed of carbonaceous material flowing downwardly through the kiln. The oxygen agitates the carbonaceous material bed at the lower end of the kiln, which in turn ignites a portion of this carbonaceous material, providing the energy necessary to perpetuate the calcining process. Thus, as long as the oxygen flow continues, the process is self-sustaining, without the need for other combustion fuels.

BRIEF DESCRIPTION OF THE DRAWING

The method of the present invention will be more fully described with reference to the drawing in which:

The FIGURE is a cross-sectional view of the lower protion of a rotary kiln and firing hood, illustrating the relative positions of the apparatus employed in practicing the method of the present invention.

DETAILED DESCRIPTION OF THE PREFERRED EMBODIMENT

Turning now to the FIGURE, the lower end 1 of a rotary kiln 10 is illustrated. The rotary kiln 10 has an outer shell 12 formed of a material such as steel and an inner lining 14 foraed of a refractory material, such as brick or high temperature castable refractory. The kiln 10 is sloped downwardly towards its exit end, at an angle typically between about 1°–4°, and preferably about 3°. Carbonaceous material 16, such as petroleum coke or anthracite coal, moves down the slope of the kiln 10. Kiln 10 is rotated about its axis by means not shown, but well-known to those skilled in the art, to aid in moving the carbonaceous material 16 through the kiln 10 and to expose the carbonaceous material 16 to the high temperatures within kiln 10, and thus heat the carbonaceous material 16 by radiant heat transfer to the surface of the carbonaceous material 16.

Located at the open lower end 13 of kiln 10 is a firing hood 18. Firing hood 18 rests on a floor 32 and comprises an outer shell 20 formed of a material such as steel and an inner lining 22 formed of the same refractory materials as lining 14.

Positioned within firing hood 18 is an opening 24 through which a burner 26 is located. Burner 26 is an air-combustion fuel burner, typically burning such fuels as natural gas or fuel oil, and is attached to sources of air and fuel by conventional means not shown. Burner 26 is positioned to fire its flame along the axis of kiln 10 and preferably above the bed of carbonaceous material 16. In prior systems, this burner would provide all of the combustion fuel input for the kiln 10. In the present system, burner 26 is employed only during start-up of the kiln 10 to raise the temperature of kiln 10 to its normal operating temperature.

According to the method of the present invention, a second opening 28 is provided in firing hood 18. Into this opening 28 is positioned an oxygen lance 30. This oxygen lance 30 is a water-jacketed member allowing for passage of oxygen through the firing hood 18 and into the kiln 10. The oxygen lance 30 is a commonly found item, and may be, for example, a model number RJ-4C from Union Carbide Corporation.

The oxygen lance 30 is connected to a source of gaseous oxygen, not shown, to provide a volume of gaseous oxygen to kiln 10 after start-up and during normal operation of kiln 10 ranging between about 4,000 to 30,000 standard cubic feet/hour at a pressure ranging between about 15 to 100 psig.

Unlike burner 26, oxygen lance 30 does not provide gaseous oxygen along or parallel to the axis of the kiln 10. Rather, the gaseous oxygen provided by oxygen lance 30 impinges on the bed of carbonaceous material 16. This impringement agitates the carbonaceous bed 16 at the open end 13 of the kiln 10 and, due to the elevated temperature of the carbonaceous material bed 16, ignites a portion of the carbonaceous material 16 provides the energy input necessary for operation of the kiln 10, permitting burner 26 to be shut down after start-up of kiln 10 and during normal operations of kiln 10. Burner 26 may be left in place, or may be removed from firing hood 18, with opening 24 being closed by a refractory plug or insert. Thus, the burning of a portion of carbonaceous material 16.

Calcined carbonaceous material 40 exits the kiln 10 at its opening 13 within firing hood 18. The calcined carbonaceous material 40 passes through floor 32 and through cooler feed chute 34 to a cooler, not shown, for cooling, as is typical of a calcining operation and unimportant to the present invention. Cooler feed chute 34 is formed having an outer lining 36 formed of the same aaterials as outer linings 14 and 20 and having an inner lining formed of the same refractory materials as inner linings 14 and 22.

Although the process at the present invention burns a portion of the carbonaceous material, the recovery level, i.e., the percentage of calcined carbonaceous material produced to the amount of green carbonaceous material initially provided, is as high as, or even higher than in a conventional calcining kiln. In a conventional calcining operation, the high gas flow rates produced from burner 26 during normal operations tend to entrain fine particulate carbonaceous material and carry it out of the kiln 10 along with the waste gases. The amount of fine particulates lost by entrainment in the present invention is substantially reduced, and the total carbonaceous material lost by both burning and entrainment should be no higher than, and is preferably lower than, the entrainment loass in a conventional calcining kiln. Thus, employing the present invention may actually increase production levels of the kiln.

It is thus clear that the present invention provides a method of calcining carbonaceous materials which reduces the cost of production by substituting relatively high cost combustion fuels with relatively low cost oxygen during normal kiln operation and which may increase productivity of the kiln by reducing entrained particulate loss from the kiln.

While the present invention has been described with reference to certain specific embodiments thereof, it is not intended to be so limited thereby, except as set forth in the accompanying claims.

We claim:

1. In a method for calcining carbonaceous materials comprising passing said carbonaceous materials through a rotary kiln and heating said carbonaceous material to a temperature sufficient to drive off volatile components of said carbonaceus material from said carbonaceous material the improvement comprising heating said rotary kiln to an operating temperature by means of an air-combustion fuel burner positioned at the lower end of said rotary kiln during start-up of said rotary kiln, impinging gaseous oxygen onto said carbonaceous material at said lower end of said rotary kiln when said rotary kiln has reached said operating temperature to agitate a portion of said carbonaceous material at said lower end of said rotary kiln and thereby ignite said portion of said carbonaceous material, burning said portion of said carbonaceous material to provide the necessary energy input to maintain said operating temperature in said rotary kiln and shutting down said air-combustion fuel burner when said rotary kiln has reached said operating temperature, whereby said oxygen completely replaces said air-combustion fuel burner after said start-up of said rotary kiln.

2. The method of claim 1 wherein said oxygen is supplied at a rate of between about 4,000 and 30,000 standard cubic feet per minute and at a pressure between about 15 and 100 psig.

3. The method of claim 2 wherein said carbonaceous material is petroleum coke.

4. The method of claim 2 wherein said carbonaceous material is anthracite coal.

* * * * *